United States Patent [19]

Piovesan

[11] Patent Number: 4,573,826

[45] Date of Patent: Mar. 4, 1986

[54] MOBILE CRUSHER UNIT FOR CLEARING ROUGH TERRAIN, PREPARING ROAD FORMWORKS AND ROADBEDS, OPERATING OPEN-WORKS MINES, AND THE LIKE

[75] Inventor: Alessandro Piovesan, Rovigo, Italy

[73] Assignee: ATIC S.r.l., Taglio Di Po, Italy

[21] Appl. No.: 594,832

[22] Filed: Mar. 29, 1984

[30] Foreign Application Priority Data

May 23, 1983 [IT] Italy ..... 21228 A/83

[51] Int. Cl.[4] ..... E01L 23/00

[52] U.S. Cl. ..... 404/90; 299/39; 299/36; 172/40; 172/66

[58] Field of Search ..... 404/90–92, 404/124, 133; 299/36, 39; 172/40, 45, 66, 67

[56] References Cited

U.S. PATENT DOCUMENTS

| | | | |
|---|---|---|---|
| 448,770 | 3/1891 | Arrington | 172/40 |
| 2,539,136 | 1/1951 | Hite | 404/90 X |
| 2,865,268 | 12/1958 | Gardner | 404/90 |
| 3,504,598 | 4/1970 | Haker | 404/90 |
| 3,952,811 | 4/1976 | Carre | 404/90 X |
| 4,149,600 | 4/1979 | van der Lely | 172/40 |
| 4,256,182 | 3/1981 | Nething | 172/45 |
| 4,463,509 | 8/1984 | Leonard | 404/90 X |

FOREIGN PATENT DOCUMENTS

| | | | |
|---|---|---|---|
| 1227873 | 8/1960 | France | 404/90 |

*Primary Examiner*—Stephen J. Novosad
*Assistant Examiner*—Beverly E. Hjorth
*Attorney, Agent, or Firm*—Bucknam and Archer

[57] ABSTRACT

The unit comprises a power-driven horizontal rotor including a shaft carrying radially mounted tool sets comprising hammers swivel-mounted at at least an intermediate point of the major dimension thereof. Upstream of the shaft there is a serrated blade subjected to oscillatory movements in a normal direction to the plane of lay thereof, the rotor and blade being carried on a frame the rearward end whereof is mounted on two wheels interconnected by an axle adapted to be raised from and lowered onto the frame.

2 Claims, 12 Drawing Figures

MOBILE CRUSHER UNIT FOR CLEARING ROUGH TERRAIN, PREPARING ROAD FORMWORKS AND ROADBEDS, OPERATING OPEN-WORKS MINES, AND THE LIKE

BACKGROUND OF THE INVENTION

This invention relates to a mobile crusher unit for clearing rough terrain, preparing road formworks and roadbeds, operating open-work mines, and the like.

As is known, shrubby and rough terrains in general are currently cleared by means of special machines in the form of two-wheeled trailers having a horizontal rotor lying cross-wise to the machine direction of movement and having radially mounted tool sets for earth processing.

More specifically, in such conventional design machines (which may be likened to rotary hoes), the wheel axle is mounted at a fixed position relatively to the machine frame, and the rotor, which is located ahead of the axle in the direction of movement, comprises a shaft provided with radially extending knife sets.

Such prior machines, therefore, do not lend themselves for clearing rough terrain where large blocks or boulders are encountered at the surface or directly under it. These machines have, in fact, a limited digging depth capability and can only be operated over terrains of moderate roughness.

Indeed, the digging depth may be varied within small limits by raising and lowering the machine drawbar; however, this results in a machine unbalance and obvious adverse consequences.

A further disadvantage of prior machines is that the rotary tools, when striking boulders or other obstructions, tend to drive them deeper into the ground instead of crushing them.

SUMMARY OF THE INVENTION

It is a task of this invention to remove such prior drawbacks by providing a mobile crusher unit, whereby very rough terrains may be cleared and large size surfacing boulders, shrubs, stumps, blocks, debris, and whatever makes the terrain unusable crushed.

Within that task, it is a main object of this invention to provide a mobile crusher unit which can clear terrain even at a relatively great depth, said depth being adjustable to meet changing requirements.

It is another object of the invention to provide a mobile crusher unit, which can be advantageously used to prepare road formworks and roadbeds.

A further object of this invention is to provide a mobile crusher unit, which can also be used for operating open-work mines.

According to one aspect of the present invention, the above task and objects, such as will be more apparent hereinafter, are achieved by a mobile crusher unit according to the main claim.

BRIEF DESCRIPTION OF THE DRAWINGS

Further features and advantages of the mobile crsuher unit according to the invention will be more readily understood from the following description of a preferred embodiment of this crusher unit, as illustrated, by way of example only, in the various views of the accompanying drawings, where.

DESCRIPTION OF THE PREFERRED EMBODIMENT

Figures 1, 2:
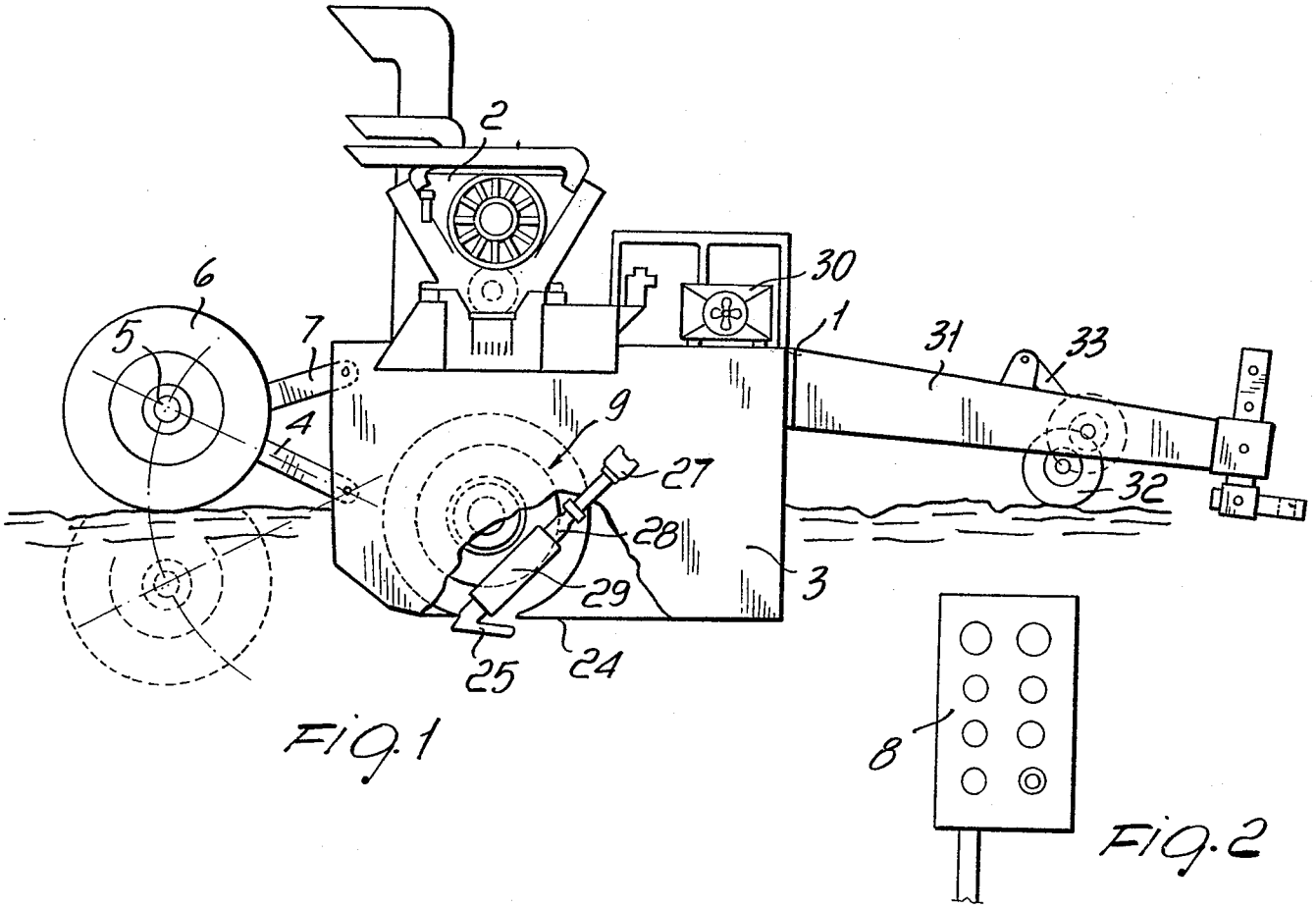
FIG. 1 shows schematically a side view of this crusher unit, as set up for trailering.
FIG. 2 shows a generical control panel for mounting on the unit itself or towing vehicle.
Figure 3:
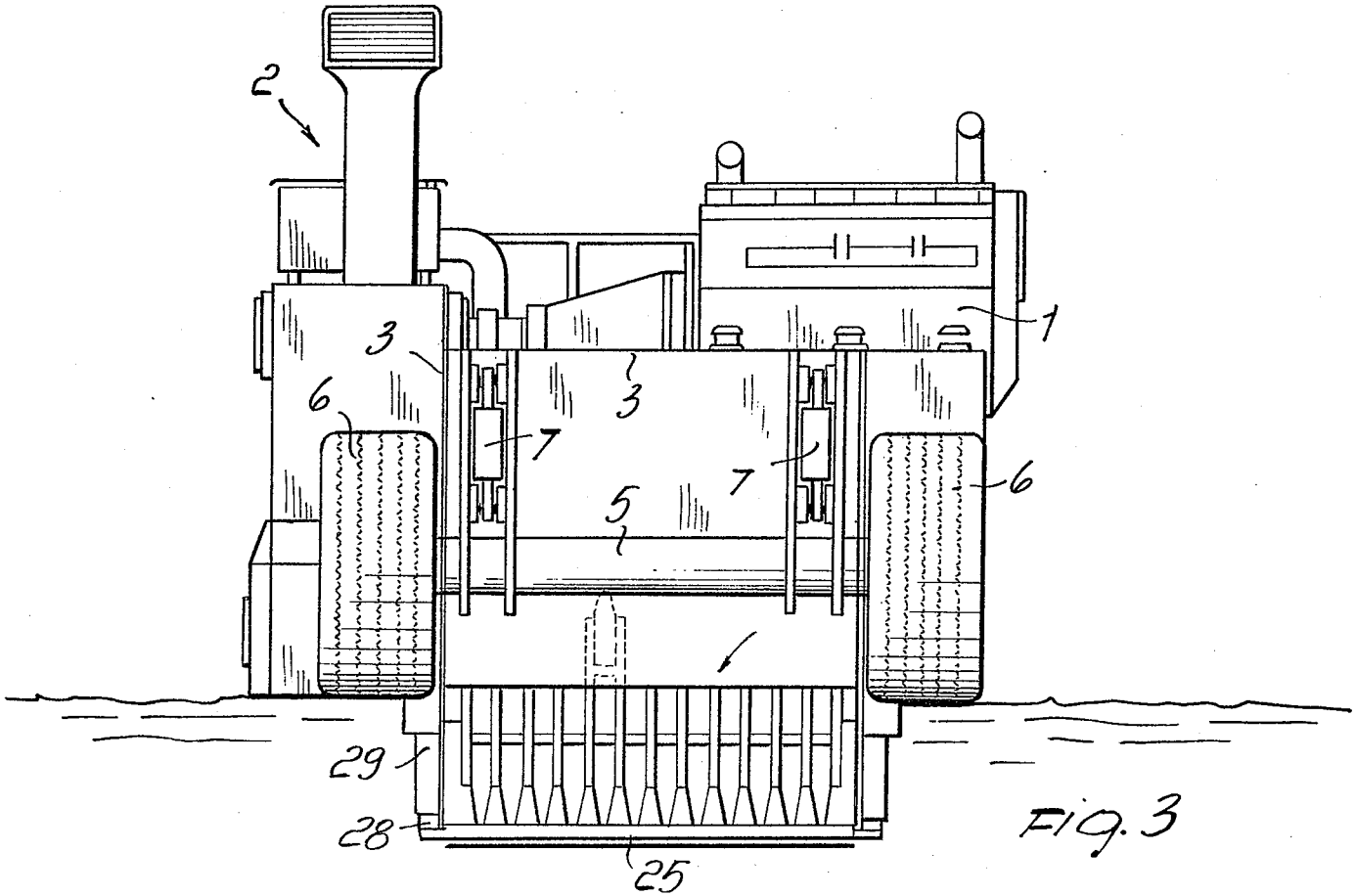
FIG. 3 is a rear view of this towing assembly.
Figure 4:
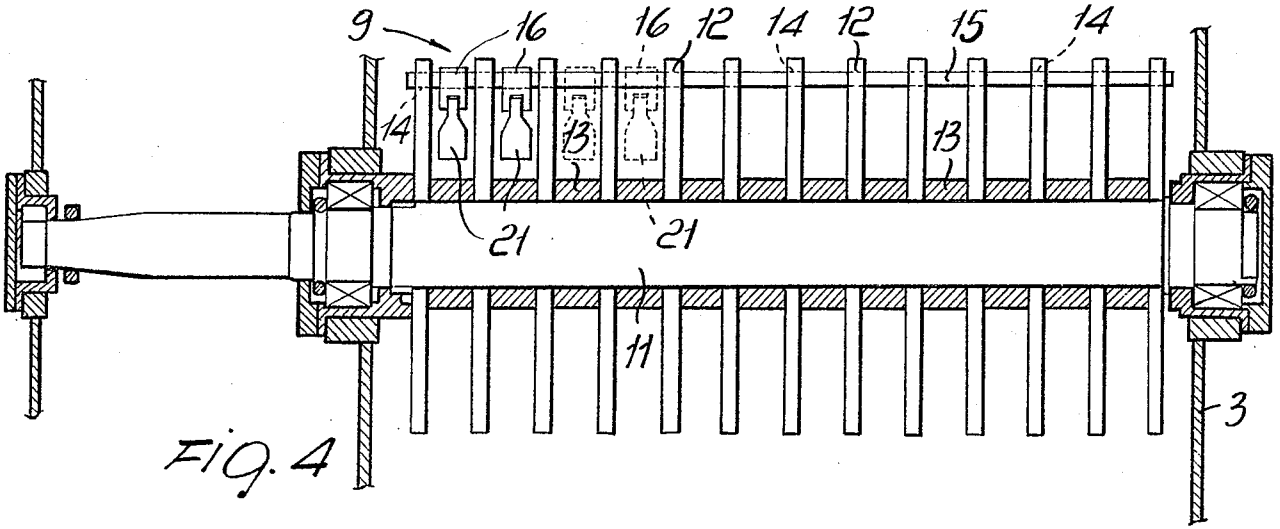
FIG. 4 shows, in longitudinal section, the rotor, and a cylindrical bar adapted to secure hammers between discs keyed coaxially to the rotor shaft.
Figure 7A:
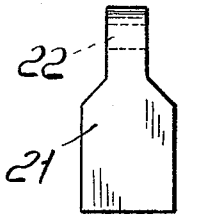
FIGS. 7A and 7B show a side view and front view, respectively, of such a hammer.
Figure 7B:
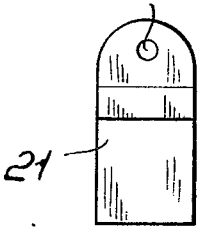
Figure 6:
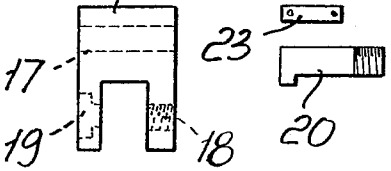
FIG. 6 shows a yoke which forms a holder element for a hammer, and connection members adapted to secure said yoke to the hammer.
Figure 5:
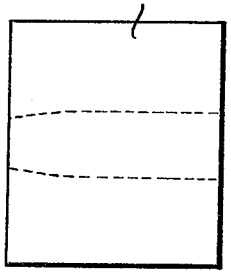
FIG. 5 shows a pulley which is mounted to one end of the rotor shaft and is driven by the drive assembly.

Referring in particular to the reference numerals used in the various drawing views, this mobile crusher unit comprises a bearing frame 1 which carries above a drive assembly 2, and below a body 3 open at three sides (front, rear, and bottom sides).

Articulated to the rear of said frame are oscillation arms 4 attached to an axle 5 which has a wheel pair 6 mounted thereon.

Attached to said axle are also a pair of double-acting hydraulic jacks 7, which are again articulated to the frame 1 and controlled from pushbuttons installed on a special control panel 8.

Journalled in the lower portion of the body 3, in a perpendicular direction to the direction of movement, is a horizontal rotor 9 driven off the cited power drive assembly either via conventional drive members or a pulley 10 keyed to one end thereof.

Said horizontal rotor comprises a shaft 11 which has circular discs 12 attached thereto, said discs being held apart by spacers 13 and provided, adjacent their edges, with at least three throughgoing holes 14 at symmetrical locations with respect to the shaft.

Through said aligned holes in said discs, there are passed as many cylindrical bars 15 which carry, in rotary fit, yokes or hammer holders 16 formed with corresponding throughgoing cross holes 17.

Said yokes are each arranged, in practice, between one pair of discs 12 and have at corresponding positions of their legs two throughgoing holes, one 18 of which is threaded, and the other 19 has a suitably enlarged cross-section portion.

Secured in rotary fit between said legs by means of a threaded pin 20, is a hammer 21 comprising essentially an elongate prismatic element having a corresponding through hole 22.

Also provided is a small plate 23 for attachment, by means of screw fasteners, to the outer wall of the leg having the hole 19 therein, and being effective to firmly lock the pin 20 therein.

In particular, the arrangement of the rotor 9 inside the body 3 is such that, while rotating, the circumference described by the apex of each hammer, at the full extension position thereof, is nearly tangent the horizontal plane defined by the bottom edges 24 of said body.

It should be further pointed out that the body sidewalls preferably flare out at their front portion or leading portion relatively to the direction of forward movement, so as to permit all of the material gathered at the machine front section to be conveyed toward the rotor 9.

Located below the hammers 21 and directly upstream thereof relatively to the cited direction of movement, is a blade 25 having its longitudinal axis laid horizontal and perpendicular to the direction of forward movement.

Figure 8:
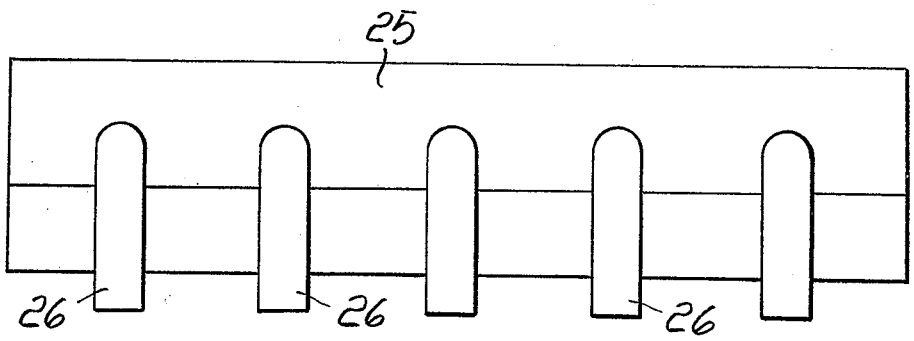
FIG. 8 is a plan view of the oscillating serrated blade.
Figure 9:
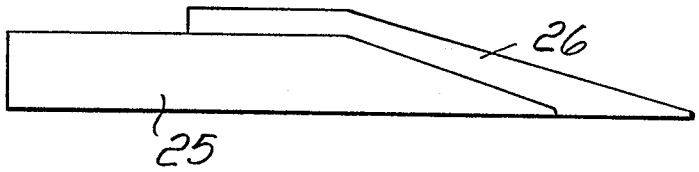
FIG. 9 is a side view of that same oscillating blade.
Figure 10:
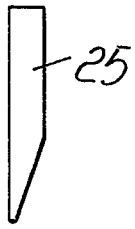
FIG. 10 shows the blade profile, without serrations.
Figure 11:
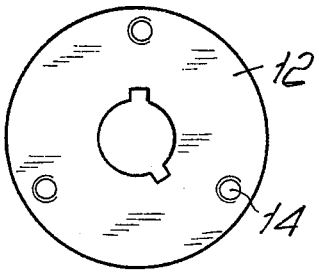
FIG. 11 shows one of the discs keyed to the rotor shaft.

Said blade, as shown in FIGS. 8, 9 and 10, has a trapezoidal cross-sectional configuration and a set of serrations or projecting teeth 26 effective to improve its penetration of the ground.

That same blade is also caused to vibrate in a normal plane to its plane of lay (as suitably inclined and forming in a horizontal plane a given angle, e.g. of 15°, with the direction of forward movement), with small amplitude movements at a preferred rate ranging from 100 to 200 oscillations per minute.

Such oscillatory movements are produced by the action of a pair of double-acting hydraulic jacks 27, having parallel axes and being adequately inclined from vertical, which jacks are attached to the body sidewalls and controlled through electronically activated solenoid valves.

Connection of the piston rods of said jacks to the corresponding ends of the blade 25 is accomplished by means of a rod 28 covered with a protective sleeve 29.

Also contemplated is the provision of a suitable heat exchanger 30 adapted to apply an effective cooling action on the working oil of said jacks.

In particular, the bearing frame 1 may have a frontally mounted drawbar 31 provided with a jockey wheel 32 the position of which may be adjusted by means of a conventional device 33 for road trailering where the unit is not self-propelled.

From the foregoing description and observation of the various views in the accompanying drawings, the improved functionality and convenience of use which characterize this mobile crusher unit may be fully appreciated.

Of course, this crusher unit has been described hereinabove and illustrated by way of example and not of limitation, for the sole purpose of showing the practical applicability and general features of this invention, and the crusher unit as disclosed herein may be changed and modified as may occur to the skilled one without departing from the scope of its inventive principles.

I claim:

1. A mobile crusher unit, comprising a power driven horizontal rotor including a shaft rotatively carrying spaced-apart discs provided, adjacent the edges thereof, with at least three throughgoing round holes located at symmetrical locations with respect to said shaft, through said aligned holes in said discs there being passed as many cylindrical bars carrying, in rotary fit, hammer yoke holders each whereof is positioned between a said disc pair and has, at least at corresponding locations on the legs thereof, two throughgoing holes, one of which is threaded and the other has an enlarged cross-section portion, secured between each leg pair of said hammer yoke holders, in rotary fit by means of a threaded pin, there being a hammer comprising substantially an elongate prismatic element having a corresponding throughgoing hole, a serrated blade being further provided, located at a lower level than said shaft and having a horizontal longitudinal axis, said serrated blade being subjected to oscillatory movements in a normal direction to the plane of lay thereof, said rotor and blade being carried on a self-propelled frame the rearward end whereof is mounted on two wheels interconnected by an axle adapted to be raised from and lowered onto said frame, a pair of double-acting hydraulic jacks being provided for producing the oscillatory movements of said blade, said jacks having parallel axes and forming a given angle from vertical, the connection between the piston rods of said jacks and the corresponding ends of said oscillating blade being accomplished by means of a rod encompassed by a protective sleeve.

2. A mobile crusher unit according to claim 1, wherein said blade extends on an inclined plane forming in a horizontal plane an angle of substantially 15° with the direction of forward movement, the blade movements having a small amplitude and occurring with a rate in the 100 to 200 oscillations per minute range.

* * * * *